United States Patent [19]

Willis

[11] Patent Number: 4,759,032

[45] Date of Patent: Jul. 19, 1988

[54] ELECTRODE SEAL ASSEMBLY

[75] Inventor: Jack R. Willis, Columbia, Tenn.

[73] Assignee: Monsanto Company, St. Louis, Mo.

[21] Appl. No.: 56,939

[22] Filed: Jun. 3, 1987

[51] Int. Cl.[4] ..... H05B 7/12

[52] U.S. Cl. ..... 373/95

[58] Field of Search ..... 373/94, 95, 96, 101

[56] References Cited

U.S. PATENT DOCUMENTS

| | | | |
|---|---|---|---|
| 678,446 | 7/1901 | Warner . | |
| 1,549,431 | 8/1925 | Beck | 373/95 |
| 2,979,550 | 4/1961 | Sherman, Sr. . | |
| 3,378,619 | 4/1968 | Rhodes . | |
| 3,379,816 | 4/1986 | Hozven . | |
| 3,683,095 | 8/1972 | Salmin et al. . | |
| 3,697,660 | 3/1970 | Frolov et al. . | |
| 3,709,506 | 11/1970 | Beerman | 277/12 |
| 3,835,233 | 9/1974 | Prenn . | |
| 4,238,634 | 1/1979 | Krogsrud . | |
| 4,295,001 | 10/1981 | Britton . | |
| 4,377,289 | 3/1983 | Lefebvre | 277/12 |
| 4,442,526 | 4/1984 | Rappinger et al. | 373/95 |
| 4,457,002 | 6/1984 | Mathgen et al. | 373/95 |

*Primary Examiner*—Roy N. Envall, Jr.
*Attorney, Agent, or Firm*—R. Loyer; W. Brooks; A. Hoffman

[57] ABSTRACT

The invention is directed to a seal assembly for sealing an electrode movable vertically through an opening in the roof of an electrode furnace. The seal assembly comprises a lower assembly including an annular base adapted for sealing engagement with the roof around the roof opening, an annular wall extending up from the base, and an annular scraper extending generally radially inwardly relative to the wall and having an inner edge adapted for scraping material from the outer surface of the electrode as the electrode moves vertically. The seal assembly also includes an upper assembly comprising a pair of annular seals of refractory material disposed in vertically spaced relation, each seal comprising a plurality of discrete arcuate seal segments, a mechanism for applying an inward radial pressure to each seal to hold it in sealing engagement with the electrode, and a mechanism for holding each seal against upward movement relative to the roof as the electrode moves up through the roof opening.

26 Claims, 3 Drawing Sheets

ELECTRODE SEAL ASSEMBLY

BACKGROUND OF THE INVENTION

This invention relates generally to electric arc furnaces in which one or more electrodes extend through an opening or openings in the roof of the furnace, and more particularly to a seal assembly for preventing the escape of gases and the like from the furnace through an electrode opening in the roof.

To accommodate lateral movement of an electrode during operation of an electric arc furnace, the roof opening through which the electrode extends is substantially larger than the diameter of the electrode, leaving an annular gap through which gases and other furnace material may escape. Accordingly, it is necessary to seal this gap. Various sealing mechanisms have been used, but all have substantial drawbacks.

For a description of various prior electrode sealing devices, reference may be made to U.S. Pat. Nos. 3,683,095, 3,709,506, 4,238,634, 3,697,660, 678,446, 2,979,550, 4,442,526, 4,295,001, 3,379,816, 3,378,619, 4,377,289, 4,457,002 and 3,835,233.

SUMMARY OF THE INVENTION

Among the several objects of this invention may be noted the provision of an improved electrode seal assembly for sealing the roof opening through which an electrode extends; the provision of such a seal assembly which operates at relatively low temperatures to provide a safer working environment; the provision of such a seal assembly wherein water is not used to make the seal between the furnace gases and the atmosphere, thereby avoiding water contamination and the problems associated therewith; the provision of such a seal assembly which uses non-toxic components; the provision of such a seal assembly which is easy to maintain and highly reliable; and the provision of such a seal assembly which is adapted to decrease furnace downtime and thus increase furnace operating time.

Generally, a seal assembly of the present invention is adapted for sealing an electrode movable vertically through an opening in the roof of an electrode furnace. The seal assembly comprises a lower assembly comprising an annular base adapted for sealing engagement with the roof around the roof opening, an annular wall extending up from the base, and an annular scraper extending generally radially inwardly relative to the wall and having inner edge means adapted for scraping material from the outer surface of the electrode as the electrode moves vertically. The seal assembly also includes an upper assembly above the lower assembly comprising a pair of annular seals of refractory material disposed in vertically spaced relation, each seal comprising a plurality of discrete arcuate seal segments, means for applying an inward radial pressure to each seal to hold it in sealing engagement with the electrode, and means for holding each seal against upward movement relative to the roof as the electrode moves up through the roof opening.

In a second aspect of the invention, the seal assembly comprises a lower assembly including an annular base adapted for sealing engagement with the roof around the roof opening, an annular wall extending up from the base, and cooling means secured to the annular wall. The seal assembly further comprises an upper assembly above the lower assembly comprising a pair of annular seals of refractory material disposed in vertically spaced relation, each seal comprising a plurality of discrete arcuate seal segments, means for applying an inward radial pressure to each seal to hold it in sealing engagement with the electrode, means for holding each seal against upward movement relative to the roof as the electrode moves up through the roof opening, and an annular plenum enclosing the lower seal of said pair of seals, said plenum having an inlet for the introduction of a gas into the plenum.

In a third aspect of this invention, the seal assembly comprises a lower assembly including an annular base adapted for sealing engagement with the roof around the roof opening, an annular wall extending up from the base, and cooling means secured to the annular wall. The seal assembly also includes an upper assembly above the lower assembly comprising a pair of annular seals of refractory material disposed in vertically spaced relation, each seal comprising a plurality of discrete arcuate seal segments, means for applying an inward radial pressure to each seal to hold it in sealing engagement with the electrode, and means for holding each seal against upward movement relative to the roof as the electrode moves up through the roof opening. The upper assembly is movable independently of the lower assembly in side-to-side direction to accommodate lateral movement of the electrode.

Other objects and features of this invention will become in part apparent and will be in part pointed out hereinafter.

BRIEF DESCRIPTION OF THE DRAWINGS

Corresponding parts are identified by the same reference numerals in the several views of the drawings.

DESCRIPTION OF THE PREFERRED EMBODIMENT

Figure 1:
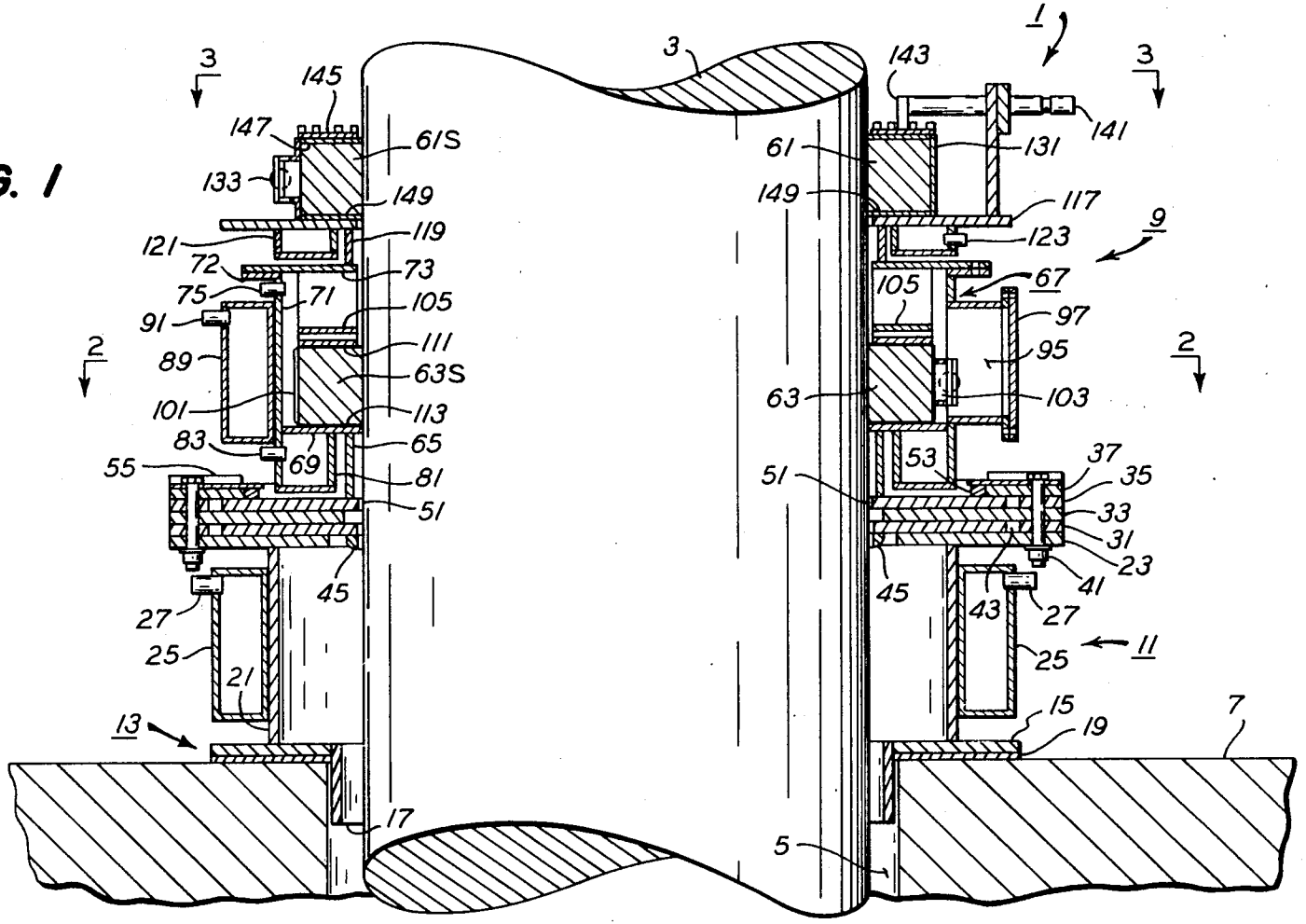
FIG. 1 is a cross-sectional elevation showing an electrode seal assembly of the present invention installed around an electrode.

Referring now to the drawings, and first to FIG. 1, there is generally indicated at 1 a seal assembly of the present invention for sealing an electrode 3 movable vertically through a opening 5 in the roof 7 of an electrode furnace, the purpose of the seal assembly being to seal the opening 5 and thus prevent the escape of noxious gases from the furnace. The seal also functions to cool the electrode, as will appear. As shown, the seal assembly generally comprises upper and lower assemblies generally designated 9 and 11, respectively.

More specifically, the lower assembly 11 comprises an annular base generally indicated at 13 comprising a base ring 15, a cylindric flange 17 depending from the inner edge of the base ring 15 into the electrode opening 5, and a heat resistant gasket 19 (e.g., asbestos) between the base ring and the furnace roof to seal against the escape of gases. An annular wall 21 extends up from the base ring 15 and has a support ring 23 secured (e.g., welded) to its upper edge lying in a generally horizontal plane. A plurality (e.g., eight) of water cooling jackets 25 are secured at spaced intervals around the annular wall 21 for cooling the wall and the electrode 3. Each jacket has an inlet 27 and an outlet (not shown) for the flow of cooling water to and from the jacket.

A series of spacer rings 31, 33, 35, 37 stacked flat on one another adjacent the outer periphery of the support plate 23 are secured to the support plate by bolts 41. As illustrated in FIG. 1, spacer rings 31, 35 and 37 are relatively narrow and spacer ring 33 is relatively wide, extending radially inwardly somewhat beyond the inner edge of the support plate 23. Suitable gaskets (not shown) may be provided between the spacer rings 31, 33, 35 and 37 and the support plate 23 to obtain a gas-tight seal between these members.

An annular scraper 43 is disposed on the support plate 23 below spacer ring 33 and extends radially inward relative to the annular wall 21, the inner edge of the scraper having blade means thereon in the form of a downwardly directed blade 45 for scraping material buildup off the outer surface of the electrode to maintain it smooth and relatively clean. The relatively close clearance fit between the scraper and the electrode also blocks material from blowing up from the furnace into the upper assembly 9 of the seal. The annular scraper 43 has an outer diameter substantially less than the inner diameter of spacer ring 31 to provide the horizontal clearance necessary to permit side-to-side movement of the scraper in a generally horizontal plane to accommodate lateral shifting or movement of the electrode during operation of the furnace, as when the electrode is raised and lowered relative to the contents of the furnace. The spacing between the support plate 23 and spacer ring 33 should be sufficient to provide the vertical clearance necessary to permit such horizontal movement of the scraper.

The upper assembly 9 comprises a base ring 51 disposed between spacer rings 33 and 37 of the lower assembly 11. The base ring 51 has an outer diameter less than the inner diameter of the spacer ring 35 to provide the horizontal clearance necessary to permit independent side-to-side movement of the base ring 51 (and thus the entire upper assembly 9) relative to the lower assembly 11 to accommodate the aforementioned lateral movement of the electrode. The spacing between the spacer rings 33 and 37 is such as to provide the vertical clearance necessary to permit such movement of the base ring. To seal against leakage of gases between base ring 51 and spacer ring 37, packing 53 is provided adjacent the inner edge of spacer ring 37. This packing is held in sealing engagement with the upper surface of the base ring 51 by a packing ring 55 secured in position by bolts 41.

Figure 2:
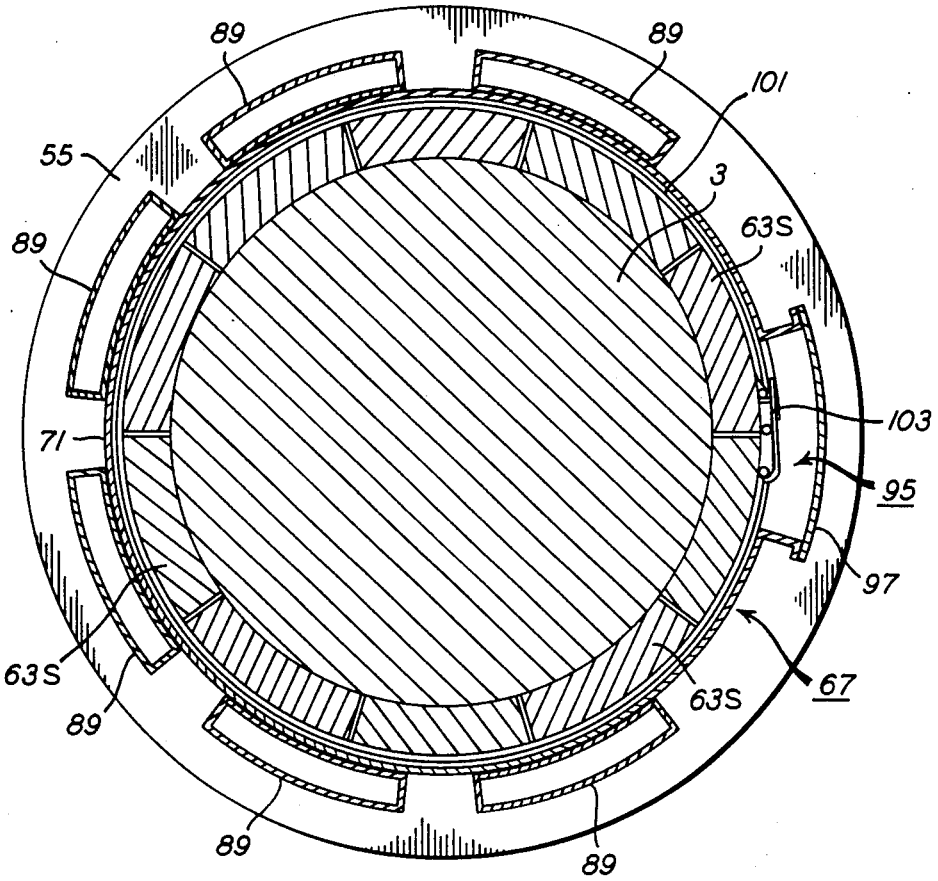
FIG. 2 is a horizontal section taken on line 2—2 of FIG. 1.
Figure 3:
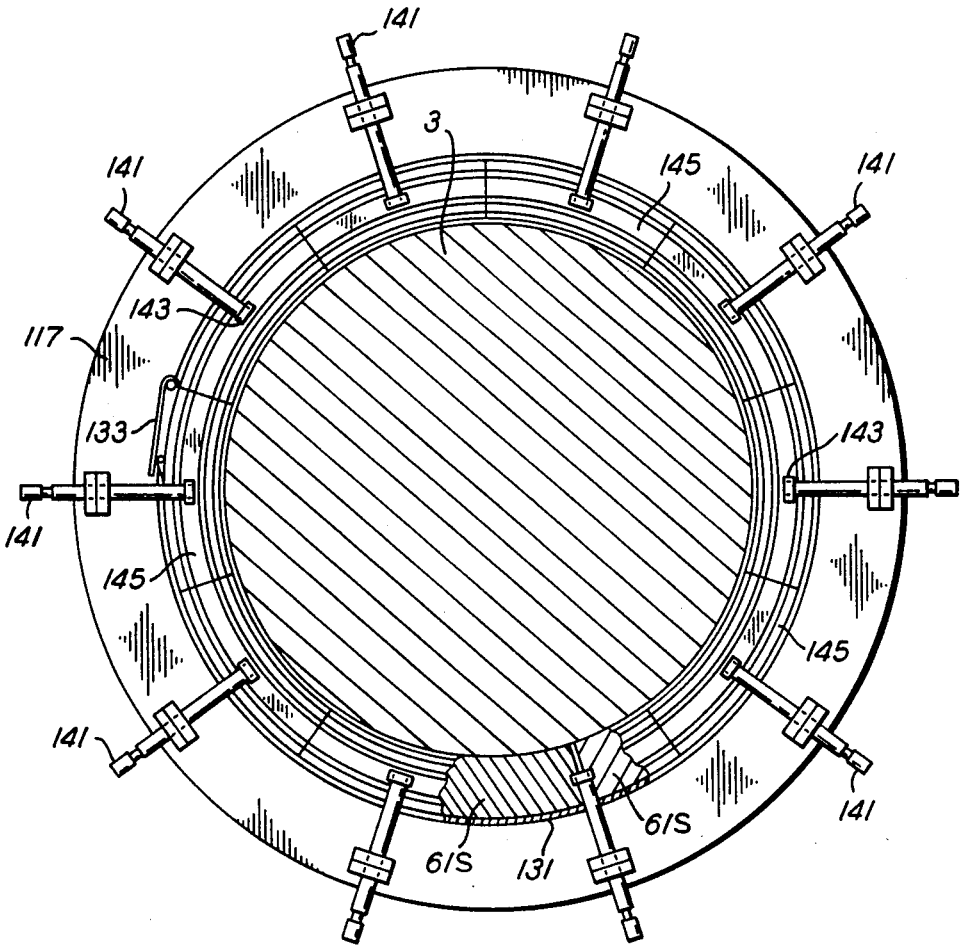
FIG. 3 is a horizontal section taken on line 3—3 of FIG. 1.

The upper assembly also includes a pair of annular seals of refractory material (e.g., graphite) disposed in vertically spaced relation on the electrode 3, the upper seal being designated 61 and the lower seal 63. As best illustrated in FIGS. 2 and 3, each seal comprises a plurality of discrete arcuate seal segments 61S, 63S which combine to provide the overall annular seal shape and which are capable of inward and outward radial movement relative to the electrode to offset wear due to vertical movement of the electrode. For example, for an electrode having a diameter of 45 inches (114.3 cm.), each seal 61, 63 may comprise eight arcuate graphite blocks, each having a thickness of about five inches (12.7 cm.); and for an electrode having a diameter of 55 inches (139.7 cm.), each seal may comprise ten arcuate graphite blocks, each having a thickness of about five inches (12.7 cm.). A suitable mastic is preferably used to seal the spaces between the seal segments. The mastic, which may be an asphalt water-based mastic, should remain soft and pliable at high temperatures to permit radial movement of the segments while maintaining the seal between the segments.

The seals 61, 63 are supported in the positions shown by a structure comprising an annular wall 65 extending up from the base ring 51 adjacent the inner edge of the base ring, and an annular plenum generally designated 67 enclosing the lower seal 61. The plenum 67 has a bottom wall 69 supported by annular wall 65, a vertical side wall 71 having an outwardly extending flange 72 at its upper end, a top wall 73 removably secured (e.g., bolted) to flange 72, an inlet 75 for the introduction of an inert pressurized gas into the plenum, and an outlet (not shown) for the exit of gas from the plenum. A gasket (not shown) may be used to ensure a sealing fit between flange 72 and the top wall 73 of the plenum. The introduction of gas into the plenum is advantageous for cooling the upper assembly 9 and electrode 3 and also for inhibiting the upward passage of gas from the furnace past the lower seal 63, which is supported by the lower wall 69 of the plenum. An annular cooling gland 81 with an inlet 83 and outlet (not shown) for a suitable cooling fluid (e.g., water) is disposed on the underside of the bottom wall 69 of the plenum 67 to provide additional cooling. The inner and bottom walls of this gland 81 are spaced from annular wall 65 and base ring 51, respectively, to permit outward drainage of any water leaking from the cooling gland. For further cooling, an appropriate number (e.g., six) of cooling jackets, each designated 89 and each having an inlet 91 and an outlet (not shown), are secured to the side wall 71 of the plenum at spaced intervals around the plenum. An opening 95 closed by an access door 97 is provided in the side wall of the plenum to inspect the lower seal segments 63S. The lower seal segments 63S are also accessible for replacement or repair, for example, by removing the top wall 73 of the plenum.

A metal band 101 of stainless steel, for example, encircles the lower seal segments 63S and constitutes means for applying an inward radial pressure to the seal to hold it in sealing engagement with the electrode. A ratchet and spring mechanism 103 maintains the band in tension as the seal segments move radially inwardly toward the electrode to allow for wear. Mechanism 103 also provides for adjustment of the band 101 to vary the amount of inward pressure applied to the seal segments. The ratchet and spring mechanism 103 is accessible through access door 97. A plurality of seal hold-downs 105 (one for each seal segment 63S) depend from the top wall 73 of the plenum 67 and constitute means for holding the seal 63 against upward movement relative to the roof of the furnace as the electrode moves upwardly. Stainless steel gaskets indicated at 111 and 113 are disposed between these hold-downs 105 and the upper surface of the seal 63 and between the bottom wall 69 of the plenum and the lower surface of the seal to provide a gas-tight seal and to facilitate inward radial movement of the lower seal segments in the event this should be necessary to accommodate lateral movement of the electrode, although it will be understood that, for the most part, lateral electrode movement is accommodated by a complimentary lateral movement of the entire upper assembly 9 relative to the lower assembly 11.

The upper seal 61 is supported on an annular seal support 117 secured, as by welding, atop an annular wall 119 extending up from the top wall 73 of the plenum 67 adjacent the inner edge thereof. An annular cooling gland 121 with an inlet 123 and outlet (not shown) is mounted on the underside of seal support 117 above the top wall 73 of the plenum 67 to cool the upper seal 61 and the electrode 3. The inner and bottom walls of this gland 121 are spaced from annular wall 119 and the top wall 73 of the plenum, respectively, to permit outward drainage of any water leaking from the cooling gland.

The upper seal 61 is held in pressure engagement with the electrode 3 by a metal band 131 having a ratchet and spring mechanism 133 comparable to metal band 101 with the mechanism 103 described above in connection with the lower seal 63. The segments 61S of the upper seal 61 are held against vertical upward movement as the electrode moves upwardly by means of a plurality of eccentric hold-downs 141 (one for each seal segment 61S), each comprising an eccentric 143 rotatable on an axis extending generally radially with respect to the electrode 3 between a hold-down position (FIG. 1) in which the eccentric is in pressure engagement with a pressure plate 145 atop a respective seal segment, and a release position (not shown) enabling the pressure plate to be removed for access to the seal segment. Stainless steel gaskets 147 and 149 may be provided between the pressure plates 145 and the upper surface of the seal 61 and between the seal support 117 and the lower surface of the seal to provide a gastight seal and to facilitate inward radial movement of the upper seal segments should this be necessary to accommodate lateral movement of the electrode, although, as previously mentioned, lateral electrode movement is accommodated for the most part by a complimentary lateral movement of the entire upper assembly 9 relative to the lower assembly 11.

The seal assembly 1 can be held from upward movement by the usual means of attachment of annular base 13 to the roof 7. Also hold-down 141 may be attached to a fixed object prohibiting upward movement as the electrode is withdrawn from the furnace.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A seal assembly for sealing an electrode movable vertically through an opening in the roof of an electrode furnace, comprising:

a lower assembly comprising an annular base adapted for sealing engagement with the roof around the roof opening, an annular wall extending up from the base, and an annular scraper extending generally radially inwardly relative to the wall and having inner edge means adapted for scraping material from the outer surface of the electrode as the electrode moves vertically; and an upper assembly above said lower assembly comprising a pair of annular seals of refractory material disposed in vertically spaced relation, each seal comprising a plurality of discrete arcuate seal segments, means for applying an inward radial pressure to each seal to hold it in sealing engagement with the electrode, and means for holding each seal against upward movement relative to the roof as the electrode moves up through the roof opening.

2. A seal assembly as set forth in claim 1 wherein said annular scraper is movable in a generally horizontal plane relative to said annular base to accommodate lateral movement of the electrode.

3. A seal assembly as set forth in claim 2 wherein said inner edge means comprises blade means at an inner edge of the scraper.

4. A seal assembly as set forth in claim 1 further comprising an annular plenum enclosing the lower seal of said pair of seals, said plenum having an inlet for the introduction of a gas into the plenum.

5. A seal assembly as set forth in claim 4 further comprising one or more cooling jackets secured to an outside wall of said plenum.

6. A seal assembly as set forth in claim 4 wherein said plenum has an opening therein providing access to said lower seal, and a door closing said opening.

7. A seal assembly as set forth in claim 1 wherein said annular seals are movable in a radial direction to accommodate lateral movement of the electrode.

8. A seal assembly as set forth in claim 7 wherein the entire upper assembly is movable in side-to-side direction independent of said lower assembly to accommodate lateral movement of the electrode.

9. A seal assembly as set forth in claim 1 further comprising cooling means on said annular wall of the lower assembly.

10. A seal assembly as set forth in claim 1 wherein said means for applying an inward radial pressure to each seal comprises a band adapted to encircle a seal and means for tensioning the band thereby to apply said inward radial pressure.

11. A seal assembly for sealing an electrode movable vertically through an opening in the roof of an electrode furnace, comprising:

a lower assembly comprising an annular base adapted for sealing engagement with the roof around the roof opening, an annular wall extending up from the base, and cooling means secured to the annular wall; and an upper assembly above said lower assembly comprising a pair of annular seals of refractory material disposed in vertically spaced relation, each seal comprising a plurality of discrete arcuate seal segments, means for applying an inward radial pressure to each seal to hold it in sealing engagement with the electrode, means for holding each seal against upward movement relative to the roof as the electrode moves up through the roof opening, and an annular plenum enclosing the lower seal of said pair of seals, said plenum having an inlet for the introduction of a gas into the plenum.

12. A seal assembly as set forth in claim 11 further comprising one or more cooling jackets secured to an outside wall of said plenum.

13. A seal assembly as set forth in claim 11 wherein said plenum has an opening therein providing access to said lower seal, and a door closing said opening.

14. A seal assembly as set forth in claim 11 further comprising an annular scraper extending generally radially inwardly relative to the wall and having inner edge means adapted for scraping material from the outer surface of the electrode as the electrode moves vertically.

15. A seal assembly as set forth in claim 14 wherein said annular scraper is movable in a generally horizontal plane relative to said annular base to accommodate lateral movement of the electrode.

16. A seal assembly as set forth in claim 15 wherein said inner edge means comprises blade means at an inner edge of the scraper.

17. A seal assembly as set forth in claim 11 wherein said means for applying an inward radial pressure to each seal comprises a band adapted to encircle a seal and means for tensioning the band to apply said inward radial pressure.

18. A seal assembly for sealing an electrode movable vertically through an opening in the roof of an electrode furnace, comprising:

a lower assembly comprising an annular base adapted for sealing engagement with the roof around the roof opening, an annular wall extending up from the base, and cooling means secured to the annular wall; and an upper assembly above said lower assembly comprising a pair of annular seals of refractory material disposed in vertically spaced relation, each seal comprising a plurality of discrete arcuate seal segments, means for applying an inward radial pressure to each seal to hold it in sealing engagement with the electrode, and means for holding each seal against upward movement relative to the roof as the electrode moves up through the roof opening;

said upper assembly being movable independently of the lower assembly in side-to-side direction to accommodate lateral movement of the electrode.

19. A seal assembly as set forth in claim 18 further comprising an annular scraper extending generally radially inwardly relative to the annular wall of the lower assembly and having inner edge means adapted for scraping material from the outer surface of the electrode as the electrode moves vertically.

20. A seal assembly as set forth in claim 19 wherein said annular scraper is movable in a generally horizontal plane relative to said annular base to accommodate lateral movement of the electrode.

21. A seal assembly as set forth in claim 20 wherein said inner edge means comprises blade means at an inner edge of the scraper.

22. A seal assembly as set forth in claim 18 further comprising an annular plenum enclosing the lower seal of said pair of seals, said plenum having an inlet for the introduction of a gas into the plenum.

23. A seal assembly as set forth in claim 22 further comprising one or more cooling jackets secured to an outside wall of said plenum.

24. A seal assembly as set forth in claim 23 wherein said plenum has an opening therein providing access to said lower seal, and a door closing said opening.

25. A seal assembly as set forth in claim 18 wherein said means for applying an inward radial pressure to each seal comprises a band adapted to encircle a seal and means for tensioning the band to apply said inward radial pressure.

26. A seal assembly as set forth in claim 18 wherein said annular seals are of graphite.

* * * * *